US005499084A

United States Patent [19]

Folkins et al.

[11] Patent Number: 5,499,084

[45] Date of Patent: Mar. 12, 1996

[54] DEVELOPMENT SYSTEM FOR USE IN A COLOR PRINTER

[75] Inventors: Jeffrey J. Folkins; Daniel M. Bray, both of Rochester; Alexander J. Fioravanti, Penfield, all of N.Y.

[73] Assignee: Xerox Corporation, Stamford, Conn.

[21] Appl. No.: 212,531

[22] Filed: Mar. 14, 1994

[51] Int. Cl.[6] ..... G03G 15/08; G03G 15/01

[52] U.S. Cl. ..... 355/259; 118/653

[58] Field of Search ..... 355/259, 265, 355/326 R, 261, 245; 118/653, 645

[56] References Cited

U.S. PATENT DOCUMENTS

| | | | |
|---|---|---|---|
| 4,403,848 | 9/1983 | Snelling | 355/4 |
| 4,833,503 | 5/1989 | Snelling | 355/259 |
| 4,868,600 | 9/1989 | Hays | 355/259 |
| 5,194,905 | 3/1993 | Brewington | 355/326 R |
| 5,311,258 | 5/1994 | Brewington et al. | 355/261 X |
| 5,341,197 | 8/1994 | Folkins et al. | 355/264 |

*Primary Examiner*—Joan H. Pendegrass
*Attorney, Agent, or Firm*—H. Fleischer; J. E. Beck; R. Zibelli

[57] ABSTRACT

A multicolor electrophotographic printing machine employing a plurality of developer units. Each of the developer units is actuated to develop a selected latent image with the appropriately colored toner particles. The other developer units are de-energized. In the development mode, the electrode wires and the donor roll are electrically biased to suitable voltages. In the non-development mode, the electrode wires have only a DC voltage applied thereon with the AC voltage being turned off. Substantially, simultaneously therewith, the electrical bias on the donor roll is adjusted to prevent further development. In this way, the developer unit does not develop a latent image in the non-operable mode and does not attract toner particles thereto from the latent image.

10 Claims, 3 Drawing Sheets

DEVELOPMENT SYSTEM FOR USE IN A COLOR PRINTER

This invention relates to color printing, and more particularly concerns a development system for developing selected colors during each cycle of the printing machine.

A typical electrophotographic printing machine employs a photoconductive member that is charged to a substantially uniform potential so as to sensitive the surface thereof. The charged portion of the photoconductive member is exposed to a light image of an original document being reproduced. Exposure of the charged photoconductive member selectively dissipates the charge thereon, in the irradiated area, to record an electrostatic latent image on the photoconductive member corresponding to the informational areas contained within the original document. After the electrostatic latent image is recorded on the photoconductive member, the latent image is developed by bringing a developer material into contact therewith. Generally, the electrostatic latent image is developed with a dry developer material comprising carrier granules having toner particles adhering triboelectrically thereto. The toner particles are attracted to the latent image forming a visible powder image on the photoconductive surface. After the electrostatic latent image is developed with the toner particles, the toner powder image is transferred to a copy sheet. Thereafter, the toner image is heated to permanently fuse it to the copy sheet.

It is highly desirable to use an electrophotographic printing machine of this type to produce color prints. In order to produce a color print, it is frequently necessary to form yellow, magenta and cyan color separations. One skilled in the art will appreciate that the black separation can be made first rather than last. In this way, a permanent color print is formed.

Various types of development systems are frequently employed in color printing machines. For example, a single component developer unit or a two component developer unit may be utilized. Single component development systems use a donor roll for transporting charged toner to the development nip defined by the donor roll and photoconductive member. The toner is developed on the latent image recorded on the photoconductive member by a combination of mechanical and/or electrical forces. Two component development systems have been used extensively in many different types of printing machines. A two component development system usually employs a magnetic brush developer roller for transporting carrier having toner adhering triboelectrically thereto. Two component development systems and single component development systems each have their advantages. Accordingly, it is desirable to combine these systems to form a hybrid development system having the desirable features of each of these systems. In a color printing machine, it is necessary to selectively actuate one of a plurality of different color developer units. Thus, only one developer unit is actuated during each development cycle. Successive developer units are subsequently activated as each different color separation is developed. It is necessary to de-energize the other developer units in order to prevent intermingling of differently colored toner particles on the latent image. Not only must the non-activated developer units not deposit toner particles on the latent image, but they must also not remove toner particles from the latent image. Thus, the non-actuated developer units must not develop or clean toner particles from the latent image. Various types of color printing machines and development systems have heretofor been employed. The following disclosures appear to be relevant:

US-A-4,403,848
Patentee: Snelling
Issued: Sep. 13, 1983
US-A-4,833,503
Patentee: Snelling
Issued: May 23, 1989
USA-4,868,600
Patentee: Hays et al.
Issued: Sep. 19, 1989
U.S. Application No.: 07/986,312
Applicant: Folkins et al.
Filed: Dec. 7, 1992

The relevant portions of the foregoing disclosures may be summarized as follows:

US-A-4,403,84 and U.S.-A-4,833,503 disclose a multicolor electrophotographic printing machine in which a color separation latent image is formed on a photoconductive belt and developed with the appropriately colored toner particles. Thereafter, successive color separated latent images are formed and developed in superimposed registration with one another. In this way, a composite multicolor latent image is formed on the photoconductive belt and subsequently transferred to a sheet. The composite image on the sheet is then fused thereto.

U.S.-A-4,868,600 describes a development system in a which a donor roll has toner deposited thereon. A pair of electrode wires are closely spaced to the donor roll in the gap between the donor roll and the photoconductive member. An AC voltage is applied to the electrode wires to detach toner from the donor roll and form a toner powder cloud in the gap. Toner from the toner powder cloud is attracted to and develops the latent image recorded on the photoconductive member. A magnetic roll transports carrier having toner particles adhering triboelectrically thereto to a loading zone adjacent the donor roll. At the loading zone, toner particles are attracted from the carrier granules to the donor roll.

U.S. Application No. 07/986,312 describes a developer unit in which the potential between the magnetic brush roller and the donor roller is adjusted so that toner particles are attracted from the donor roll to the magnetic roller, thereby cleaning the donor roll.

In accordance with one aspect of the features of the present invention, there is provided an apparatus for developing a latent image. The apparatus comprises a donor member adapted to transport toner and an electrode. Means are provided for electrically biasing the donor member. Means electrically bias the electrode. A controller is associated with the donor biasing means and the electrode biasing means. The controller sets the electrode biasing means to an electrode development voltage and the donor biasing means to a donor development voltage in a development mode and set the electrode biasing means to an electrode non-development voltage and the donor biasing means to a nondevelopment voltage in the non-development mode.

Pursuant to another aspect of the present invention, there is provided an electrophotographic printing machine of the type in which a latent image is developed on photoconductive member. The improvement in the printing machine comprises a plurality of developer units with each developer unit being adapted to develop the latent image with different color developer material. One of the plurality of developer units is in an operable mode with the other of the plurality of developer units being in a non-operable mode. Each of the developer units includes a donor member adapted to transport developer material and an electrode. Means are provided for electrically biasing the donor member. Means electrically bias the electrode. A controller is associated with the donor biasing means and the electrode biasing means. The controller sets the electrode biasing means to an electrode development voltage and the donor biasing means to a donor development voltage in the operable mode and sets the electrode biasing means to an electrode non-development voltage and the donor biasing means to a non-development voltage in the non-operable mode.

Other aspects of the present invention will become apparent as the following, description proceeds and upon reference to the drawings, in which.

Figure 1:
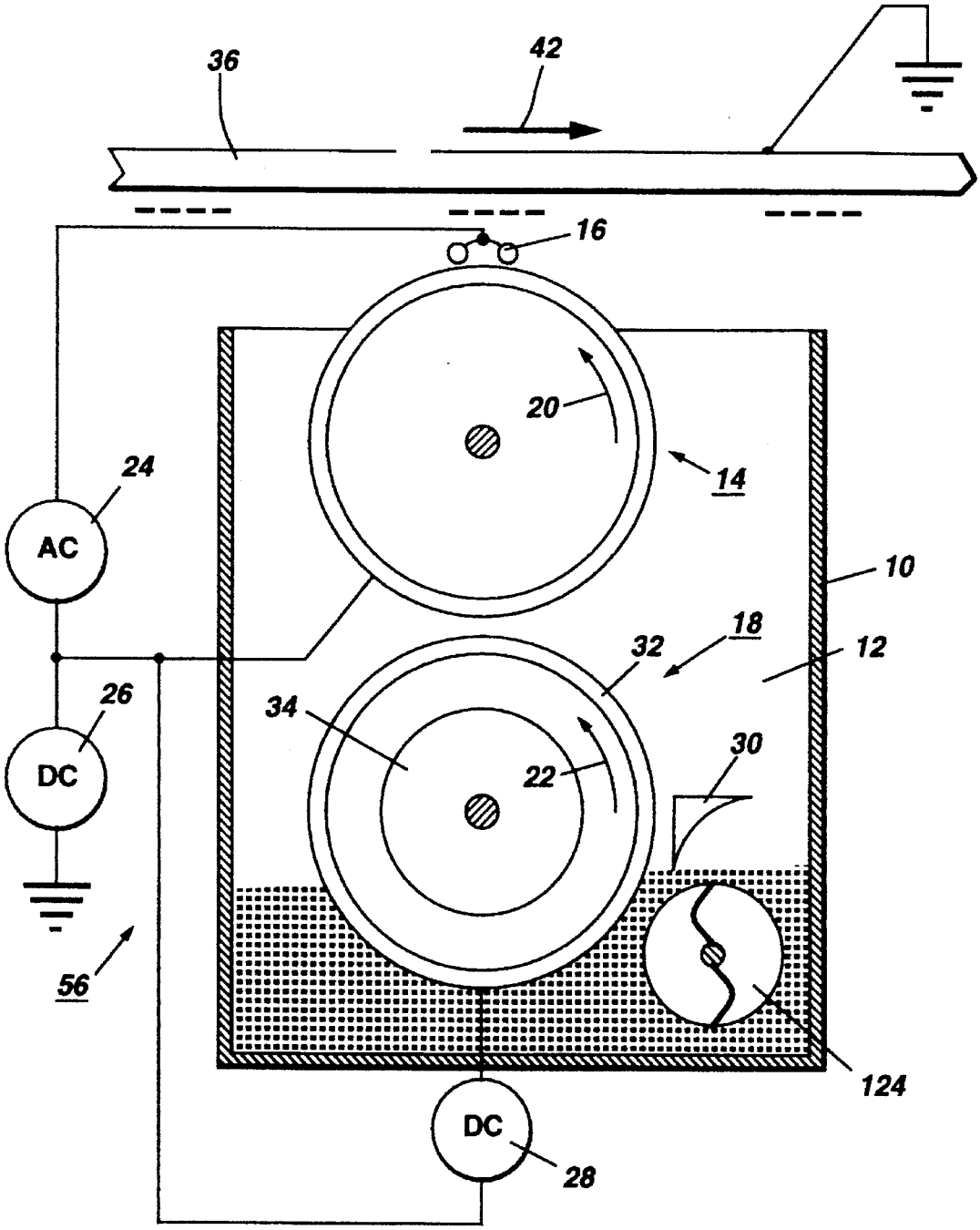
FIG. 1 is a schematic, elevational view showing a development unit used in the FIG. 3 printing machine.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements.

Figure 3:
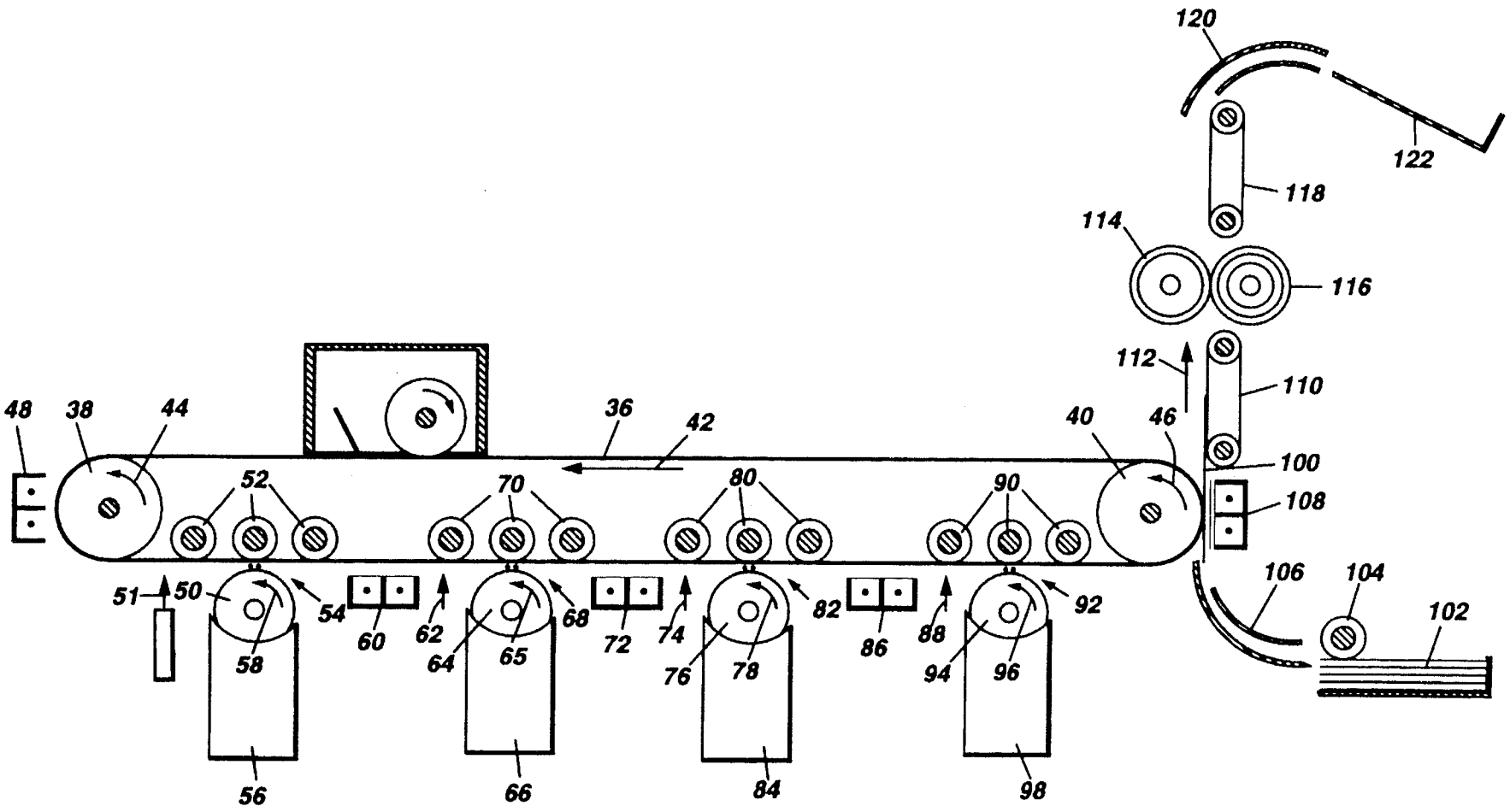
FIG. 3 is a schematics, elevational view of an illustrative electrophotographic printing machine incorporating the FIG. 1 developer unit therein.

Referring initially to FIG. 3, there is shown a multicolor electrophotographic printing machine incorporating the features of the present invention therein. The printing machine employs a belt 36 having a photoconductive surface deposited on a conductive substrate. Preferably, the photoconductive surface is made from a selenium alloy with the conductive substrate being made preferably from an aluminum alloy which is electrically grounded. Belt 36 advances successive portions of the photoconductive surface sequentially through the various processing stations disposed about the path of movement thereof. The support assembly for belt 36 includes two rollers, 38 and 40. These rollers are spaced apart with roller 38 being rotatably driven by a suitable motor and drive (not shown) so as to rotate and advance belt 36 in the direction of arrow 42. Roll 38 rotates in the direction of 44 arrow and roll 40 rotates in the direction of arrow 36.

Initially, belt 36 passes through a charging station. At the charging station, a corona generating device 48 charges the photoconductive surface of belt 36 to a relatively high, substantially uniform potential.

After the photoconductive surface of belt 36 is charged, the charged portion thereof is advanced to an exposure station. At the exposure station, an imaging beam 51, generated by a raster output scanner (ROS) employing a laser with rotating polygon mirror blocks, creates a color separated electrostatic latent image on the photoconductive surface of belt 36. This color separated electrostatic latent image is developed by developer unit 56.

Developer unit 56 has a donor roll 50 with black toner particles. A plurality of idler rollers 52 locate photoconductive belt 36 precisely with respect to donor roll 50. In this way, there is a space between donor roll 50 and photoconductive belt 36 in the development zone. Electrode wires are located in this space. Black toner is detached from donor roll 50 by the electrical biasing of these electrode wires. This forms a toner powder cloud in development zone 54 and the electrostatic latent image attracts toner particles thereto. In this way, black toner develops the latent image. Donor roll 50 is electrically biased to a suitable magnitude and polarity and rotates in the direction of arrow 58.

After the black toner image has been developed on the photoconductive surface, belt 36 continues to advance in the direction of arrow 42 to a recharge station where corona generating device 60 recharges the photoconductive surface to a relatively high, substantially uniform potential. Thereafter, at the next exposure station, an imaging bean 62 from the ROS selectively dissipates the charge to record another partial electrostatic latent image on the photoconductive surface of belt 36 corresponding to regions to be developed with yellow toner particles. This partial electrostatic latent image is now advanced to the next successive developer unit which deposits yellow toner particles thereon.

The yellow developer unit 66 employs a donor roll 64 having yellow toner associated therewith. Once again, donor roll 64 is spaced from the photoconductive surface of belt 36 at development zone 68. Electrode wires are disposed in the development zone adjacent donor roll 64. Donor roll 64 rotates in the direction of arrow 65 and is electrically biased to a suitable magnitude and plurality. Here, also, idler rollers 70 precisely locate the photoconductive surface of belt 36 so as to form a gap, in development zone 68, between donor roll 64 and belt 36. The electrode wires are electrically biased to detach toner particles from the donor roll. This forms a toner powder cloud in the development zone. The electrostatic latent image attracts the toner particles from the powder cloud thereto so as to form a developed image on photoconductive belt 36.

After the electrostatic latent image has been developed with yellow toner, belt 36 advances in the direction of arrow 42 to the next recharge station. At this recharge station, a corona generating device 72 charges the photoconductive surface of belt 36 to a relatively high, substantially uniform potential. Thereafter, an imaging beam 74 from the ROS selectively discharges the charge on the photoconductive surface to record a partial electrostatic latent image for development with magenta toner particles. After the latent image is recorded on the photoconductive surface, belt 36 advances the latent image to the magenta developer station.

At the magenta developer station, a developer unit 84 has a donor roll 76 rotating in the direction of arrow 78 to transport magenta toner particles to the development zone. Idler rollers 80 support belt 36 so that the photoconductive surface is spaced from donor roll 76 at development zone 82. Donor roll 76 is electrically biased to a suitable polarity and magnitude. Electrode wires are disposed in the development zone adjacent donor roll 76. The electrode wires are electrically biased to attract toner particles from donor roll 76 forming a toner powder cloud in the development zone. The electrostatic latent image recorded on the photoconductive surface of belt 36 attracts the magenta toner particles in the toner powder cloud thereto so as to develop the latent image. In this way, a magenta toner image is formed on the photoconductive surface of belt 36.

After the magenta toner image has been formed on the photoconductive surface of belt 36, belt 36 advances to the next recharge station where corona generator 86 recharges the photoconductive surface to a relatively high, substantially uniform potential. Thereafter, imaging beam 88 selectively discharges those portions of the charged photoconductive surface which are to be developed with cyan toner. The latent image to be developed with cyan toner is advanced to the cyan development station.

At the cyan development station, idler rollers 90 precisely position the photoconductive surface of belt 36 so as to form a space in development zone 92 between belt 36 and donor roll 94. Developer unit 98 includes donor roll 94. Electrode wires are positioned in the development zone adjacent donor roll 94. Donor roll 94 rotates in the direction of arrow 96 to advance the cyan toner particles to development zone 92. A suitable electrical bias is applied to donor roll 94 so as to electrically bias it to the proper magnitude and polarity permitting cyan toner particles to be detached therefrom forming a toner powder cloud in the development zone. The cyan toner particles from the powder cloud are attracted to the electrostatic latent image.

Figure 2:
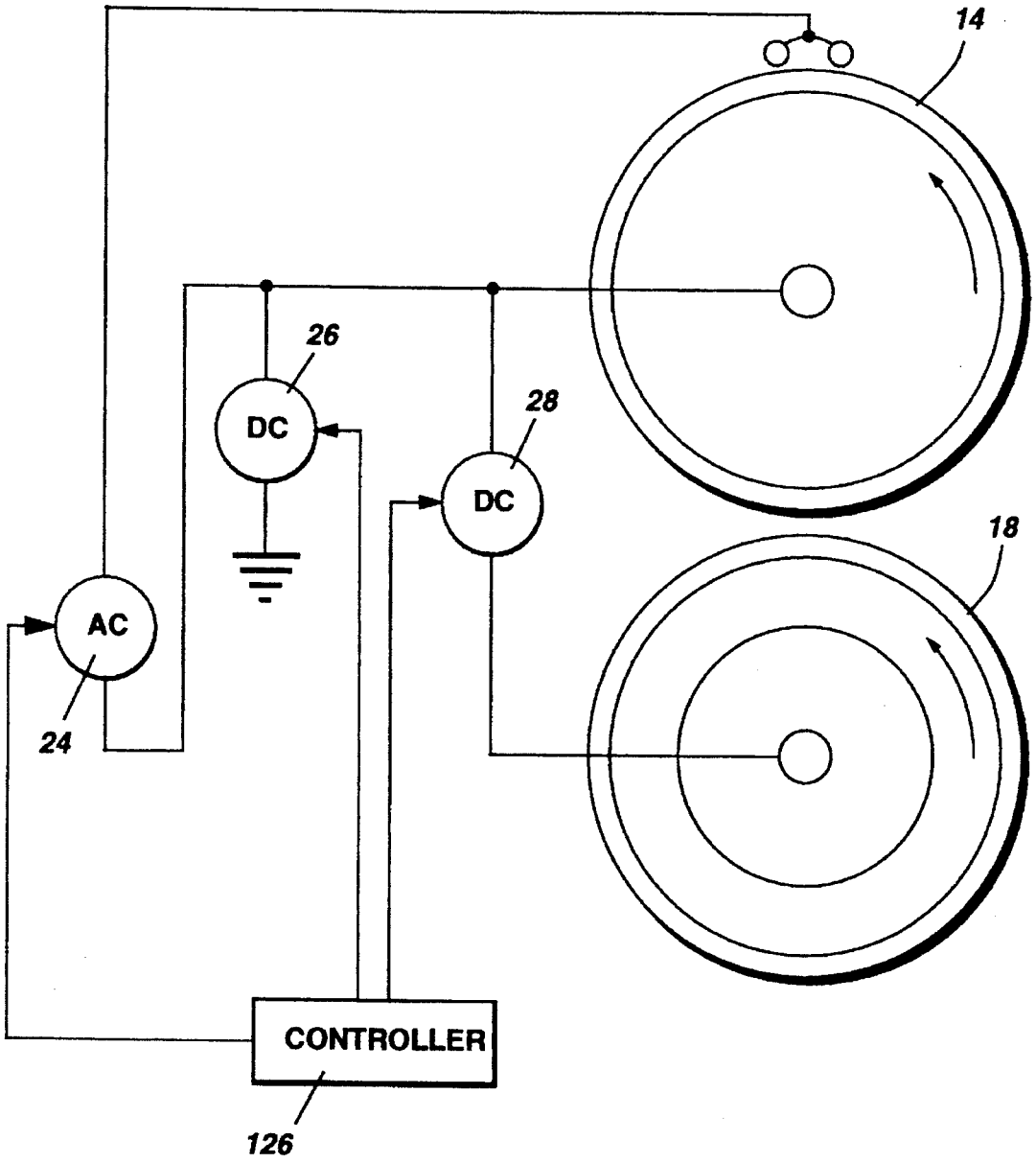
FIG. 2 is a schematic, elevational view showing the electrical arrangement for changing voltages in the FIG. 1 developer unit.

It is clear from the foregoing description that each of the developer units are independently operable to develop the respective electrostatic latent image with the other developer units being nonoperable for that specific latent image. Furthermore, none of the other developer units clean or remove toner particles while being in the nonoperable condition. The foregoing will be described more fully with reference to FIGS. 1 and 2. In FIGS. 1 and 2, only one of the developer units is described in detail as the other developer units are substantially identical thereto with the only distinctions being the color of the toner particles contained therein and the levels of the electrical bias. Thus, developer unit 56 will be described hereinafter with reference to FIGS. 1 and 2 in greater detail.

At the transfer station, a sheet of support material, i.e. paper, 100, is advanced from a stack 102 by a feed roll 104. The sheet advances through a chute 106 and is guided to the transfer station. A corona generating device 108 sprays ions onto the backside of the paper. This attracts the developed image from the photoconductive surface of belt 36 to the sheet of paper 100. A conveyor belt 110 moves the sheet of paper in the direction of arrow 112 to a fusing station. While transferring the developed image to a sheet of paper has been described, one skilled in the art will appreciate that the developed image may be transferred to an intermediate member, such a belt or a drum, and then, subsequently, transferred or fused to the sheet of paper. Furthermore, while a plurality of imaging stations and charging stations have been described herein, a multicolor printing machine may employ one charging station and one imaging station and a plurality of developer units. In this type of a printing machine, the photoconductive belt passes through a plurality of cycles. During each cycle, a different color separation latent image is recorded on the photoconductive belt and developed with the appropriate developer unit.

The fusing station includes a heated fuser roll 114 and a backup or pressure roll 116 resiliently urged into engagement therewith to form a nip through which the sheet of paper passes. In the fusing operation, the toner particles coalesce with one another and bond to the sheet in image configuration forming a multicolor image thereon. After fusing, the finished sheet is discharged onto a conveyor 118. Conveyor 118 transports the sheet to a chute 120 which guides the sheet into catch tray 122 for removal therefrom by the machine operator.

Referring now to FIG. 1, there is shown developer unit 56 in greater detail. As depicted thereat, developer unit 56 includes a housing 10 defining a chamber 12 for storing a supply of developer material therein. Donor roll 14, electrode wires 16 and magnetic roll 18 are mounted in the chamber of housing 10. Donor roll can be rotated in either the "with" or "against" direction relative to the direction of motion of belt 36. In FIG. 1, donor roll 10 is shown rotating in the direction of arrow 20, i.e. the against direction. Magnetic roll 18 is shown rotating in the direction of arrow 22, i.e. the against direction. Donor roll 14 is preferably made from anodized aluminum. Developer unit 56 also has electrode wires 16 which are disposed in the space between belt 36 and donor roll 14. A pair of electrode wires are shown extending in a direction substantially parallel to the longitudinal axis of the donor roller. The electrode wires are made from one or more thin (i.e. 50–100 micron diameter) wires, (e.g. made of stainless steel or tungsten) which are closely spaced from donor roll 14. The distance between the wires and the donor roll is approximately 25 microns or about the thickness of the toner layer on the donor roll. The wires are self-spaced from the donor roll by the thickness of the toner on the donor roll. The extremities of the wires are supported by the tops of end bearing blocks which also support the donor roll for rotation. The wire extremities are attached so that they are slightly below and tangent to the surface, including the toner layer, of the donor roll structure. Mounting the wires in such a manner makes them substantially insensitive to roll run out due to their self-spacing.

With continued reference to FIG. 1, an alternating electrical bias is applied to the electrode wires 16 by an AC voltage source 24. The applied AC voltage establishes an alternating electrostatic field between the wires and the donor roll which is effective in detaching toner from the surface of the donor roll 14 and forming a toner cloud about the wires, the height of the cloud being such as not to be substantially in contact with belt 36. The magnitude of the AC voltage is on the order of 200 to 500 volts peak at a frequency ranging from about 3 kHz to about 10 kHz. A DC voltage source 26 applies approximately 300 volts to donor roller 14 so as to establish an electrostatic field between the photoconductive surface of belt 36 and donor roll 14 for attracting the detached toner particles from the clouds surrounding the wires to the latent image recorded on the photoconductive surface. At a spacing arranging from about 10 microns to about 40 microns between the electrode wires and donor roll, an applied voltage of about 200 to about 500 volts produces a relatively large electrostatic field without risk of air breakdown. The use of a dielectric coating on the electrode wires or donor roll helps to prevent shorting the applied AC voltage. One skilled in the art will appreciate that while the electrode wires have been shown in the development zone spaced from the donor roll, the electrode wires may be embedded in the donor roll surface to rotate therewith and are energized in the development zone. Magnetic roll 18 meters a constant quantity of toner having a substantially constant charge onto donor roll 14. This insures that donor roll provides a constant amount of toner having a substantially constant charge in the development gap. However, rather than using a cleaning blade, the combination of donor roll spacing, i.e. spacing between the donor roll and magnetic roll, compressed pile height of the developer material on the magnetic roll, and the magnetic properties of the magnetic roll in conjunction with the use of a conductive, magnetic developer material achieves the deposition of a constant quantity of toner having a substantially constant charge on the donor roll. A DC voltage source 28 applies approximately 100 volts to magnetic roll 18. This establishes an electrostatic field between magnetic roll 18 and donor roll 14 which causes toner particles to be attracted from the carrier granules on the magnetic roller to the donor roll. Metering blade 30 is positioned closely adjacent to magnetic roll 18 to maintain the compressed pile height of the developer material at the desired level. Magnetic roll 18 includes a non-magnetic tubular member 32 made preferably from aluminum and having the exterior circumferential surface thereof roughened. An elongated magnet 34 is positioned interiorly of and spaced from the tubular member. The magnet is mounted stationarily. The tubular member rotates in the direction of arrow 22 to advance the developer material adhering thereto into the loading nip defined by donor roll 14 and magnetic roll 18. Toner particles are attracted from the carrier granules on the magnetic roll to the donor roll.

With continued reference to FIG. 1, augers, indicated generally by the reference numeral 124 are located in chamber 12 of housing 10. Augers 124 are mounted rotatably in chamber 12 to mix and transport developer material. The augers have blades extending spirally outwardly from a shaft. The blades are designed to advance the developer material in the axial direction, substantially parallel to the longitudinal axis of the shaft.

As successive electrostatic latent images are developed, the toner particles within the developer material are depleted. A toner dispenser (not shown) stores a supply of toner particles. The toner dispenser is in communication with chamber 12 of housing 10. As the concentration of toner particles in the developer material is decreased, fresh toner particles are furnished to the developer material in the chamber from the toner dispenser. The augers in the chamber of the housing mix the fresh toner particles with the remaining developer material so that the resultant developer material therein is substantially uniform with the concentration of toner particles being optimized. In this way, a substantially constant amount of toner particles are in chamber of the developer housing with toner particles having a constant charge. The developer material in the chamber of the developer housing is magnetic and may be electrically conductive. By way of example, the carrier granules include a ferromagnetic core having a thin layer of magnetite overcoated with a non-continuous layer of resinous material. The toner particles are made from various resinous materials having the appropriate pigment therein. The DC voltages levels applied to the magnetic roller and donor roll are those necessary to achieve satisfactory development. In addition, the AC bias applied to the electrode wires is also necessary in order to form a toner powder cloud in the development zone. However, when the developer unit is in the non-operative mode, development is not desirable. Furthermore, it is highly desirable to prevent the donor roll from attracting toner particles from the developed images passing thereby on the photoconductive belt 36. This is achieved by turning the AC voltage electrically biasing the electrode wires off so that the electrode wires are only electrically biased by a DC voltage. While the AC voltage has been turned off, the electrode wires still have a DC voltage applied thereon The electrical biases applied by a DC voltage sources to the donor roll and magnetic roller are suitably adjusted so that toner particles are attracted back from the donor roll to the magnetic roll. This cleans the donor roll. Only by simultaneously accomplishing all of the foregoing is development and cleaning of the photoconductive belt prevented. The foregoing is described in greater detail with reference to FIG. 2.

While it has been described that the AC voltage electrically biasing the electrode wires is turned off and the DC voltage between the donor roll and magnetic roll adjusted to attract toner from the donor roll to the magnetic roll, on occasion, the AC voltage applied on the electrode wires is left on and only the DC voltage between the donor roll and magnetic roll adjusted to attract toner from the donor roll to the magnetic roll. This occurs when development is terminated in the middle of the process so that the donor roll is clean.

Referring now to FIG. 2, there is shown a controller 126 which turns AC voltage source 24 connected to electrode wires 16 on and off. Controller 126 also regulates DC voltage source 28. During operation, controller 126 turns AC voltage source 24 on and adjusts DC voltage source 28 between donor roll 14 and magnetic roller 18. For example, during development, the voltage on the donor roll is −100 volts and the voltage on the magnetic roller 18 is −150 volts. Controller 126 turns AC voltage source 24 off when developer unit 56 is non-operable. Simultaneously, controller 126 adjust voltage source 28 between donor roll 14 and magnetic roll 18. At this time, during the non-operable or non-development mode, the donor roll has a voltage of 300 volts applied thereon and the magnetic roller has a voltage of 250 volts thereon. It is, thus, clear that change in voltage has been 400 volts in going from the development mode to the non-development mode. The voltage difference between the donor roll and magnetic roller is maintained constant in the development mode and the non-development mode. In the example given, the voltage difference between the donor roll and the magnetic roll is 50 volts. Thus, the voltage difference between the donor roll and magnetic roller is maintained constant during the non-operable and the operable mode. In the operable mode, the AC voltage source is turned on to apply an AC electrical bias to the electrode wires. In the non-operable mode, the AC voltage source is turned off and the electrode wires are no longer electrically biased by the AC voltage source. A DC voltage is still applied to the electrode wires. In this way, the developer unit develops the latent image in the operable mode and, in the non-operable mode, does not develop the latent image. In the non-operable mode, the developer unit is prevented from developing the latent image and does not attract toner particles from any other latent images thereto.

In recapitulation, it is clear that the present invention is directed to a developer unit having a donor roll, a magnetic roll and electrode wires. In the development mode of operation, the donor roll receives toner particles from the magnetic roller. The electrode wires are electrically biased to detach toner from the donor roll forming a toner powder cloud in the development zone. In the non-development mode of operation, the electrode wires have no electrical bias applied thereon. The electrode bias on the donor and magnetic roller is suitably adjusted to prevent further development. The voltage difference between the donor roll and magnetic roll is maintained constant in the development mode and in the nondevelopment mode. Thus, in the development mode, a toner powder cloud is formed and toner particles are attracted to the latent image. contradistinction, in the non-development mode, no toner powder cloud is formed and toner particles are attracted back to the donor roll.

It is, therefore, apparent that there has been provided in accordance with the present invention, a development unit which fully satisfies the aims and advantages hereinbefore set forth. While this invention has been described in conjunction with a specific embodiment thereof for use in various types of printing machines, it is evident that many alternatives, modifications and variations will be apparent to those skilled in the art. Accordingly, it is intended to embrace all such alternatives, modifications and variations that fall within the spirit and broad scope of the appended claims.

We claim:

1. An apparatus for developing a latent image comprising:

a donor member adapted to transport toner;

an electrode;

means for electrically biasing said donor member;

means for electrically biasing said electrode to detach toner particles from said donor member to develop the latent image;

a controller, associated with said donor biasing means and said electrode biasing means to said set electrode biasing means to an electrode development voltage and said donor biasing means to a donor development voltage in a development mode, and to set said electrode biasing means to an electrode non-development voltage and said donor biasing means to a donor non-development voltage in a non-development mode;

a transport member adapted to advance toners to said donor member; and means for electrically biasing said transport member, said controller being associated with said transport biasing means to set said transport biasing means at a transport development voltage in the development mode and to set said transport biasing means to a transport non-development voltage in the non-development mode so as to attract toner from said transport member to said donor member in the development mode and to attract toner from said donor to said transport member in the non-development mode, said controller adjusts the difference between the donor development voltage and the transport development voltage to a first voltage and the difference between the donor non-development voltage and the transport non-development voltage to a second voltage, said controller sets the first voltage and the second voltage to be substantially equal to one another.

2. An apparatus according to claim 1, wherein:

said donor member comprises a roll;

said transport member comprises a magnetic roll; and said electrode comprises a wire spaced from said roll in a development zone.

3. An apparatus according to claim 1, wherein said electrode electrical biasing means electrically biases said electrode with an AC voltage and a DC voltage in the development mode.

4. An apparatus according to claim 3, wherein said electrode electrical biasing means electrically biases said electrode with a DC voltage in the non-development mode.

5. An apparatus according to claim 3, wherein said electrode electrical biasing means electrically biases said electrode with the AC voltage and a second DC voltage different from the first mentioned DC voltage in the non-development mode.

6. An electrophotographic printing machine of the type in which a latent image is developed on a photoconductive member, wherein the improvement comprises a plurality of developer units with each developer unit being adapted to develop the latent image with different color developer material, one of said plurality of developer units being in an operable mode with the other of said plurality of developer units being in a non-operable mode, each of said developer units including a donor member adapted to transport developer material to a development zone, an electrode disposed in the development zone, means for electrically biasing said donor member, means for electrically biasing said electrode to detach developer material from said donor member to develop the latent image, and a controller associated with said donor biasing means and said electrode means, to set said electrode biasing means to an electrode development voltage and said donor biasing means to an electrode development voltage and said donor biasing means to a donor development voltage in the operable mode and to set said electrode biasing means to an electrode non-development and said donor biasing means to a non-development voltage in the non-operable mode, each of said plurality of developer units further comprising a transport member adapted to advance developer material to said donor member, and means for electrically biasing said transport member, said controller being associated with said transport biasing means to set said transport biasing means to a transport development voltage in the operable mode and to set said transport biasing means to a transport non-development voltage in the non-operable mode so as to attract toner from said transport member to said donor member in the operable mode and to attract toner from said donor member to said transport member in the non-operable mode, said controller adjusts the difference between the donor development voltage and the transport development voltage to a first voltage and sets the difference between the donor non-development voltage and the transport non-development voltage to a second voltage, said controller sets the first voltage and the second voltage to be substantially equal to one another.

7. A printing machine according to claim 6, wherein:

said donor member comprises a roll;

said transport member comprises a magnetic roll; and said electrode comprises a wire spaced from said roll in a development zone.

8. A printing machine according to claim 6, wherein said electrode electrical biasing means electrically biases said electrode with an AC voltage and a DC voltage in the operable mode.

9. A printing machine according to claim 8, wherein said electrode electrical biasing means electrically biases said electrode with a DC voltage in the non-operable mode.

10. A printing machine according to claim 8, wherein said electrode electrical biasing means electrically biases said electrode with the AC voltage and a second DC voltage different from the first mentioned DC voltage in the non-operable mode.

* * * * *